US006202049B1

(12) United States Patent
Kibre et al.

(10) Patent No.: US 6,202,049 B1
(45) Date of Patent: Mar. 13, 2001

(54) IDENTIFICATION OF UNIT OVERLAP REGIONS FOR CONCATENATIVE SPEECH SYNTHESIS SYSTEM

(75) Inventors: Nicholas Kibre, Lompoc; Steve Pearson, Santa Barbara, both of CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/264,981

(22) Filed: Mar. 9, 1999

(51) Int. Cl.[7] ..... G10L 13/06
(52) U.S. Cl. ..... 704/267; 704/254
(58) Field of Search ..... 704/265, 266, 704/267, 249, 254, 258

(56) References Cited

U.S. PATENT DOCUMENTS

| | | | | |
|---|---|---|---|---|
| 5,349,645 | * | 9/1994 | Zhoa | 704/243 |
| 5,400,434 | * | 3/1995 | Pearson | 704/264 |
| 5,617,507 | * | 4/1997 | Lee et al. | 704/200 |
| 5,684,925 | * | 11/1997 | Morin et al. | 704/254 |
| 5,751,907 | | 5/1998 | Moebius et al. | 704/267 |
| 5,913,193 | * | 6/1999 | Huang et al. | 704/258 |

FOREIGN PATENT DOCUMENTS 0 805 433 * 5/1997 (EP) ..... G10L/5/04

OTHER PUBLICATIONS

Mercier, G., D. Bigorgne, L. Miclet, L. LeGuenne, and M. Querre, "Recognition of Speaker–dependent Continuous Speech with KEAL," IEE Proceedings–Communications, Speech, and Vision, Part I, vol. 136, iss. 2, Apr. 1989, pp. 145–154.*

Weigel, Walter, "Continuous Speech–Recognition with Vowel–Context–Independent Hidden Markov Models for Demisyllables," Proc. ICSLP, Kobe Japan, Nov. 1990, pp. 701–704.*

Matsui, K., S. D. Pearson, K. Hata, and T. Kamai, "Improving Naturalness in Text–to–Speech Synthesis Using Natural Glottal Source," 1991 Int. Conf. Acoust., Speech, Sig. Proc., 1991, ICASSP–91, vol. 2, Apr. 14–17 1991, pp. 769–772.*

Boeffard, O., L. Miclet, and S. White, "Automatic Generation of Optimized Unit Dictionaries for text to Speech Synthesis," Int. Conf. Spoken Language Proc., Banff, Alberta, Canada, vol. 2, Oct. 12–16, 1992, pp. 1211–1241.*

Acero, H. Hon, A., Huang, X., Liu, J., and Plumpe, M.; "Automatic Generation Of Synthesis Units For Trainable Text–To–Speech Systems"; Proceedings of the 1998 IEEE International Conference on Acoustics, Speech and Signal Processing, ICASSP '98 (Cat. No. 98CH36181) Part vol. 1; pp. 293–296 vol. 1; May 1998.

Boeffard, O., Miclet, L., and White, S.; "Automatic Generation Of Optimized Unit Dictionaries For Text To Speech Synthesis"; In *Proceedings ICSLP 92*, Baraff, Alberta, Canada; pp. 1211–1214.; 1992.

Conkie, Alistair D., and Isard, Stephen; "Optimal Coupling of Diphones"; Text–To–Speech Synthesis: Progress In Speech Synthesis Workshop; 2$^{nd}$; pp. 293–304; Spring 1996.

* cited by examiner

*Primary Examiner*—David Hudspeth
*Assistant Examiner*—Donald L. Storm
(74) *Attorney, Agent, or Firm*—Harness, Dickey & Pierce, P.L.C.

(57) ABSTRACT

Speech signal parameters are extracted from time-series data corresponding to different sound units containing the same vowel. The extracted parameters are used to train a statistical model, such as a Hidden Markov-based Model, that has a data structure for separately modeling the nuclear trajectory region of the vowel and its surrounding transition elements. The model is trained as through embedded re-estimation to automatically determine optimally aligned models that identify the nuclear trajectory region. The boundaries of the nuclear trajectory region serve to delimit the overlap region for subsequent sound unit concatenation.

15 Claims, 3 Drawing Sheets

IDENTIFICATION OF UNIT OVERLAP REGIONS FOR CONCATENATIVE SPEECH SYNTHESIS SYSTEM

BACKGROUND AND SUMMARY OF THE INVENTION

The present invention relates to concatenative speech synthesis systems. In particular, the invention relates to a system and method for identifying appropriate edge boundary regions for concatenating speech units. The system employs a speech unit database populated using speech unit models.

Concatenative speech synthesis exists in a number of different forms today, which depend on how the concatenative speech units are stored and processed. These forms include time domain waveform representations, frequency domain representations (such as a formants representation or a linear predictive coding LPC representation) or some combination of these.

Regardless of the form of speech unit, concatenative synthesis is performed by identifying appropriate boundary regions at the edges of each unit, where units can be smoothly overlapped to synthesize new sound units, including words and phrases. Speech units in concatenative synthesis systems are typically diphones or demisyllables. As such, their boundary overlap regions are phoneme-medial. Thus, for example, the word "tool" could be assembled from the units 'tu' and 'ul' derived from the words "tooth" and "fool." What must be determined is how much of the source words should be saved in the speech units, and how much they should overlap when put together.

In prior work on concatenative text-to-speech (TTS) systems, a number of methods have been employed to determine overlap regions. In the design of such systems, three factors come into consideration:

Seamless Concatenation: Overlapping to speech units should provide a smooth enough transition between one unit and the next that no abrupt change can be heard. Listeners should have no idea that the speech they are hearing is being assembled from pieces.

Distortion-free Transition: Overlapping to speech units should not introduce any distortion of its own. Units should be mixed in such a way that the result is indistinguishable from non-overlapped speech.

Minimal System Load: The computational and/or storage requirements imposed on the synthesizer should be as small as possible.

In current systems there is a tradeoff between these three goals. No system is optimal with respect to all three. Current approaches can generally be grouped according to two choices they make in balancing these goals. The first is whether they employ short or long overlap regions. A short overlap can be as quick as a single glottal pulse, while a long overlap can comprise the bulk of an entire phoneme. The second choice involves whether the overlap regions are consistent or allowed to vary contextually. In the former case, like portions of each sound unit are overlapped with the preceding and following units, regardless of what those units are. In the latter case, the portions used are varied each time the unit is used, depending on adjacent units.

Long overlap has the advantage of making transitions between units more seamless, because there is more time to iron out subtle differences between them. However, long overlaps are prone to create distortion. Distortion results from mixing unlike signals.

Short overlap has the advantage of minimizing distortion. With short overlap it is easier to ensure that the overlapping portions are well matched. Short overlapping regions can be approximately characterized as instantaneous states (as opposed to dynamically varying states). However, short overlap sacrifices seamless concatenation found in long overlap systems.

While it would be desirable to have the seamlessness of long overlap techniques and the low distortion of short overlap techniques, to date no systems have been able to achieve this. Some contemporary systems have experimented with using variable overlap regions in an effort to minimize distortion while retaining the benefits of long overlap. However, such systems rely heavily on computationally expensive processing, making them impractical for many applications.

The present invention employs a statistical modeling technique to identify the nuclear trajectory regions within sound units and these regions are then used to identify the optimal overlap boundaries. In the presently preferred embodiment time-series data is statistically modeled using Hidden Markov Models that are constructed on the phoneme region of each sound unit and then optimally aligned through training or embedded re-estimation.

In the preferred embodiment, the initial and final phoneme of each sound unit is considered to consist of three elements: the nuclear trajectory, a transition element preceding the nuclear region and a transition element following the nuclear region. The modeling process optimally identifies these three elements, such that the nuclear trajectory region remains relatively consistent for all instances of the phoneme in question.

With the nuclear trajectory region identified, the beginning and ending boundaries of the nuclear region serve to delimit the overlap region that is thereafter used for concatenative synthesis.

The presently preferred implementation employs a statistical model that has a data structure for separately modeling the nuclear trajectory region of a vowel, a first transition element preceding the nuclear trajectory region and a second transition element following the nuclear trajectory region. The data structure may be used to discard a portion of the sound unit data, corresponding to that portion of the sound unit that will not be used during the concatenation process.

The invention has a number of advantages and uses. It may be used as a basis for automated construction of speech unit databases for concatenative speech synthesis systems. The automated techniques both improve the quality of derived synthesized speech and save a significant amount of labor in the database collection process.

For a more complete understanding of the invention, its objects and advantages, refer to the following specification and to the accompanying drawings.

DESCRIPTION OF THE PREFERRED EMBODIMENT

Figure 1:
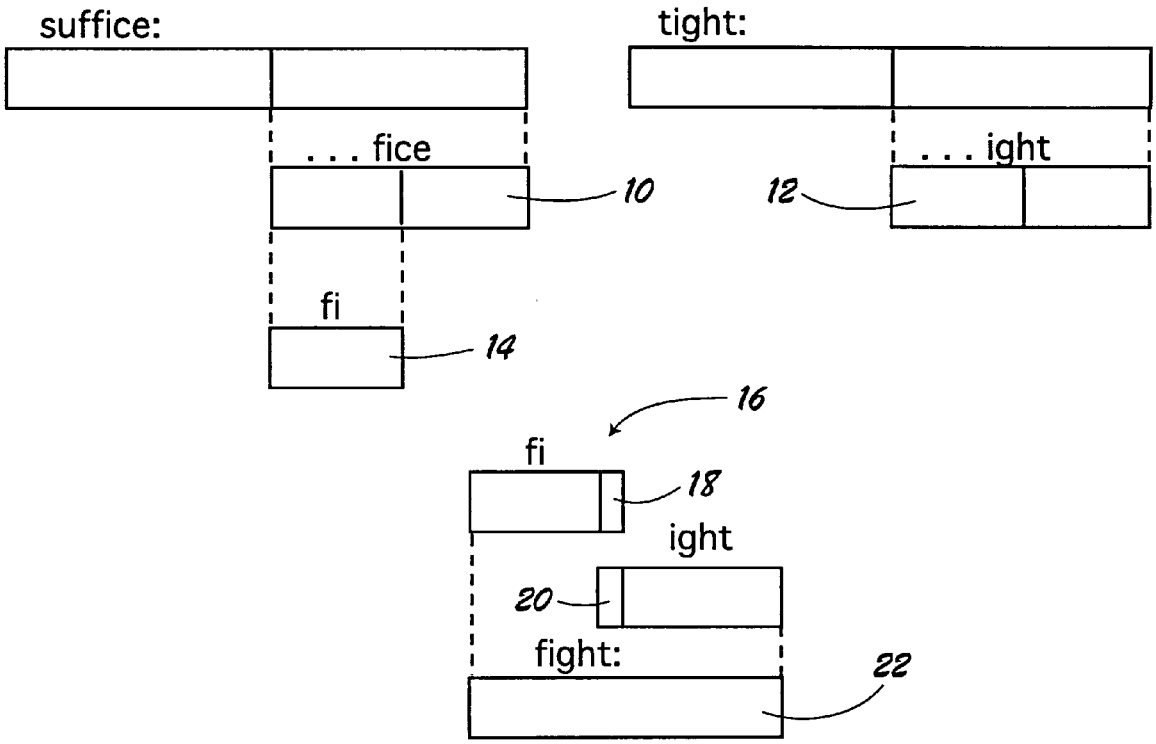
FIG. 1 is a block diagram useful in understanding the concatenative speech synthesis technique.

To best appreciate the techniques employed by the present invention, a basic understanding of concatenative synthesis is needed. FIG. 1 illustrates the concatenative synthesis process through an example in which sound units (in this case syllables) from two different words are concatenated to form a third word. More specifically, sound units from the words "suffice" and "tight" are combined to synthesize the new word "fight."

Referring to FIG. 1, time-series data from the words "suffice" and "tight" are extracted, preferably at syllable boundaries, to define sound units 10 and 12. In this case, sound unit 10 is further subdivided as at 14 to isolate the relevant portion needed for concatenation.

The sound units are then aligned as at 16 so that there is an overlapping region defined by respective portions 18 and 20. After alignment, the time-series data are merged to synthesize the new word as at 22.

The present invention is particularly concerned with the overlapping region 16, and in particular, with optimizing portions 18 and 20 so that the transition from one sound unit to the other is seamless and distortion free.

The invention achieves this optimal overlap through an automated procedure that seeks the nuclear trajectory region within the vowel, where the speech signal follows a dynamic pattern that is nevertheless relatively stable for different examples of the same phoneme.

Figure 2:
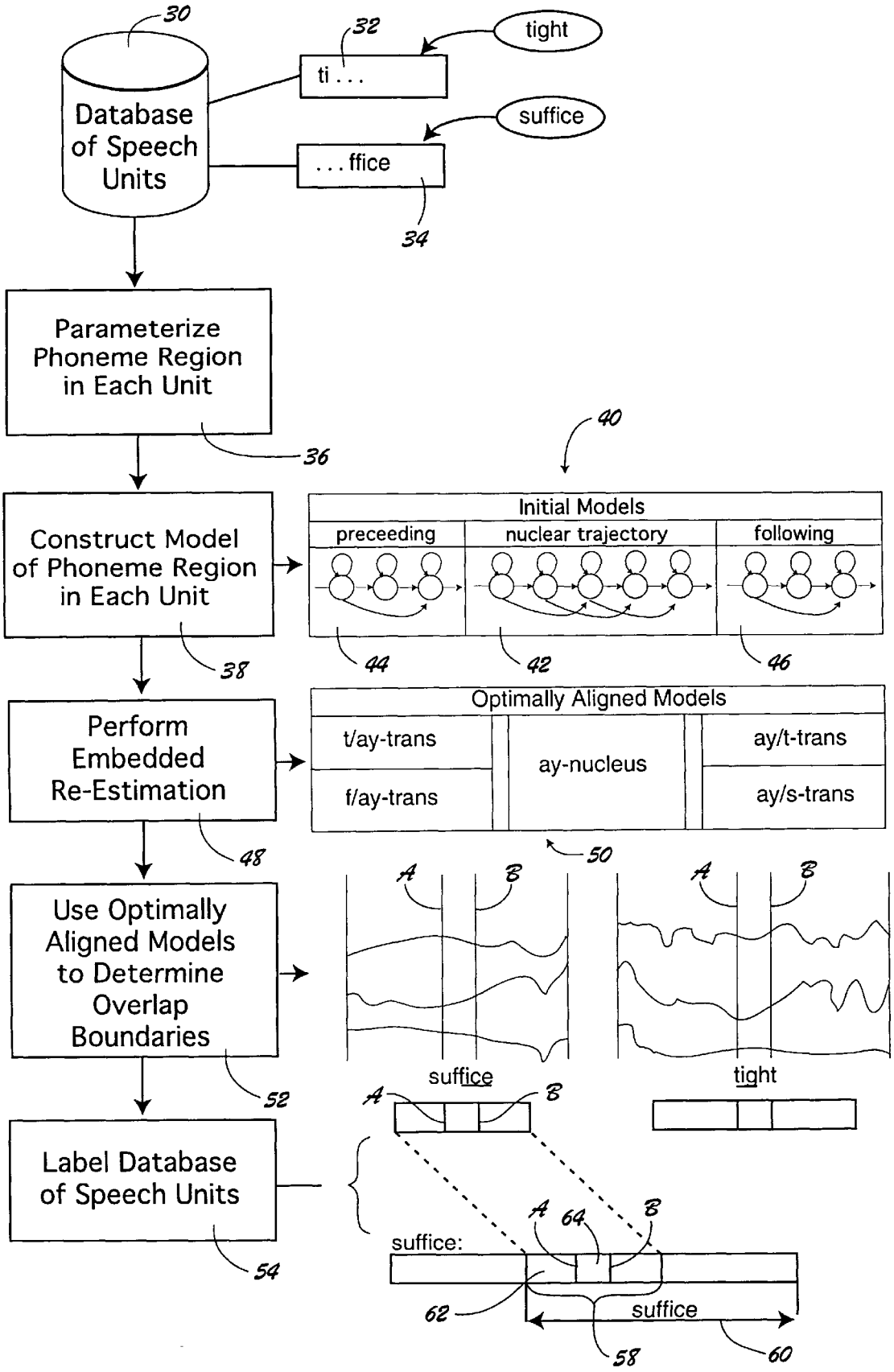
FIG. 2 is a flowchart diagram illustrating how speech units are constructed according to the invention.

The procedure for developing these optimal overlapping regions is shown in FIG. 2. A database of speech units 30 is provided. The database may contain time-series data corresponding to different sound units that make up the concatenative synthesis system. In the presently preferred embodiment, sound units are extracted from examples of spoken words that are then subdivided at the syllable boundaries. In FIG. 2 two speech units 32 and 34 have been diagrammatically depicted. Sound unit 32 is extracted from the word "tight" and sound unit 34 is extracted from the word "suffice."

The time-series data stored in database 30 is first parameterized as at 36. In general, the sound units may be parameterized using any suitable methodology. The presently preferred embodiment parameterizes through formant analysis of the phoneme region within each sound unit. Formant analysis entails extracting the speech formant frequencies (the preferred embodiment extracts formant frequencies F1, F2 and F3). If desired, the RMS signal level may also be parameterized.

While formant analysis is presently preferred, other forms of parameterization may also be used. For example, speech feature extraction may be performed using a procedure such as Linear Predictive Coding (LPC) to identify and extract suitable feature parameters.

After suitable parameters have been extracted to represent the phoneme region of each sound unit, a model is constructed to represent the phoneme region of each unit as depicted at 38. The presently preferred embodiment uses Hidden Markov Models for this purpose. In general, however, any suitable statistical model that represents time-varying or dynamic behavior may be used. A recurrent neural network model might be used, for example.

The presently preferred embodiment models the phoneme region as broken up into three separate intermediary regions. These regions are illustrated at 40 and include the nuclear trajectory region 42, the transition element 44 preceding the nuclear region and the transition element 46 following the nuclear region. The preferred embodiment uses separate Hidden Markov Models for each of these three regions. A three-state model may be used for the preceding and following transition elements 44 and 46, while a four or five-state model can be used for the nuclear trajectory region 42 (five states are illustrated in FIG. 2). Using a higher number of states for the nuclear trajectory region helps ensure that the subsequent procedure will converge on a consistent, non-null nuclear trajectory.

Initially, the speech models 40 may be populated with average initial values. Thereafter, embedded re-estimation is performed on these models as depicted at 48. Re-estimation, in effect, constitutes the training process by which the models are optimized to best represent the recurring sequences within the time-series data. The nuclear trajectory region 42 and the preceding and following transition elements are designed such that the training process constructs consistent models for each phoneme region, based on the actual data supplied via database 30. In this regard, the nuclear region represents the heart of the vowel, and the preceding and following transition elements represent the aspects of the vowel that are specific to the current phoneme and the sounds that precede and follow it. For example, in the sound unit 32 extracted from the word "tight" the preceding transition element represents the coloration given to the 'ay' vowel sound by the preceding consonant 't'.

The training process naturally converges upon optimally aligned models. To understand how this is so, recognize that the database of speech units 30 contains at least two, and preferably many, examples of each vowel sound. For example, the vowel sound 'ay' found in both "tight" and "suffice" is represented by sound units 32 and 34 in FIG. 2. The embedded re-estimation process or training process uses these plural instances of the 'ay' sound to train the initial speech models 40 and thereby generate the optimally aligned speech models 50. The portion of the time-series data that is consistent across all examples of the 'ay' sound represents the nucleus or nuclear trajectory region. As illustrated at 50, the system separately trains the preceding and following transition elements. These will, of course, be different depending on the sounds that precede and follow the vowel.

Once the models have been trained to generate the optimally aligned models, the boundaries on both sides of the nuclear trajectory region are ascertained to determine the position of the overlap boundaries for concatenative synthesis. Thus in step 52 the optimally aligned models are used to determine the overlap boundaries. FIG. 2 illustrates overlap boundaries A and B superimposed upon the formant frequency data for the sound units derived from the words "suffice" and "tight."

With the overlap boundaries having been identified in the parameter data (in this case in the formant frequency data) the system then labels the time-series data at step 54 to delimit the overlap boundaries in the time-series data. If desired, the labeled data may be stored in database 30 for subsequent use in concatenative speech synthesis.

By way of illustration, the overlap boundary region diagrammatically illustrated as an overlay template 56 is shown superimposed upon a diagrammatic representation of the time-series data for the word "suffice." Specifically, template 56 is aligned as illustrated by bracket 58 within the after syllable ". . . fice." When this sound unit is used for concatenative speech, the preceding portion 62 may be discarded and the nuclear trajectory region 64 (delimited by boundaries A and B) serves as the crossfade or concatenation region.

Figure 3:
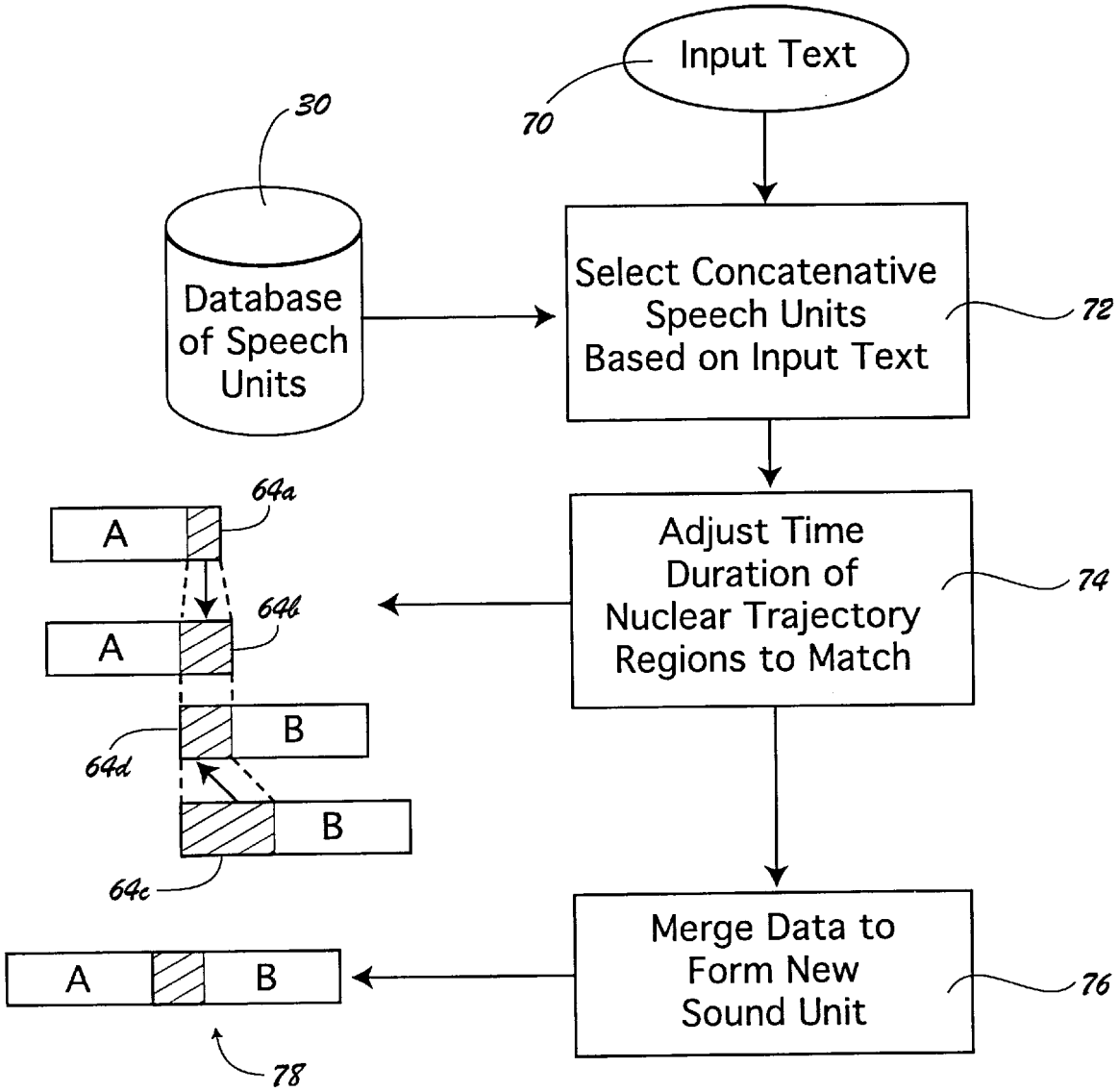
FIG. 3 is a block diagram illustrating the concatenative speech synthesis process using the speech unit database of the invention.

In certain implementations the time duration of the overlap region may need to be adjusted to perform concatenative synthesis. This process is illustrated in FIG. 3. The input text 70 is analyzed and appropriate speech units are selected from database 30 as illustrated at step 72. For example, if the word "fight" is supplied as input text, the system may select previously stored speech units extracted from the words "tight" and "suffice."

The nuclear trajectory region of the respective speech units may not necessarily span the same amount of time. Thus at step 74 the time duration of the respective nuclear trajectory regions may be expanded or contracted so that their durations match. In FIG. 3 the nuclear trajectory region 64*a* is expanded to 64*b*. Sound unit B may be similarly modified. FIG. 3 illustrates the nuclear trajectory region 64*c* being compressed to region 64*d*, so that the respective regions of the two pieces have the same time duration.

Once the durations have been adjusted to match, the data from the speech units are merged at step 76 to form the newly concatenated word as at 78.

From the foregoing it will be seen that the invention provides an automated means for constructing speech unit databases for concatenative speech synthesis systems. By isolating the nuclear trajectory regions, the system affords a seamless, non-distorted overlap. Advantageously, the overlapping regions can be expanded or compressed to a common fixed size, simplifying the concatenation process. By virtue of the statistical modeling process, the nuclear trajectory region represents a portion of the speech signal where the acoustic speech properties follow a dynamic pattern that is relatively stable for different examples of the same phoneme. This stability allows for a seamless, distortion-free transition.

The speech units generated according to the principles of the invention may be readily stored in a database for subsequent extraction and concatenation with minimal burden on the computer processing system. Thus the system is ideal for developing synthesized speech products and applications where processing power is limited. In addition, the automated procedure for generating sound units greatly reduces the time and labor required for constructing special purpose speech unit databases, such as may be required for specialized vocabularies or for developing multi-lingual speech synthesis systems.

While the invention has been described in its presently preferred form, modifications can be made to the system without departing from the spirit of the invention as set forth in the appended claims.

What is claimed is:

1. A method for identifying a unit overlap region for concatenative speech synthesis, comprising:

defining a statistical model for representing time-varying properties of speech;

providing a plurality of time-series data corresponding to different sound units containing the same vowel;

extracting speech signal parameters from said time-series data and using said parameters to train said statistical model;

using said trained statistical model to identify a recurring sequence in said time-series data and associating said recurring sequence with a nuclear trajectory region of said vowel;

using said recurring sequence to delimit the unit overlap region for concatenative speech synthesis.

2. The method of claim 1 wherein said statistical model is a Hidden Markov Model.

3. The method of claim 1 wherein said statistical model is a recurrent neural network.

4. The method of claim 1 wherein said speech signal parameters are speech formants.

5. The method of claim 1 wherein said statistical model has a data structure for separately modeling the nuclear trajectory region of a vowel and the transition elements surrounding said nuclear trajectory region.

6. The method of claim 1 wherein the step of training said model is performed by embedded re-estimation to generate a converged model for alignment across the entire data set represented by said time-series data.

7. The method of claim 1 wherein said statistical model has a data structure for separately modeling the nuclear trajectory region of a vowel, a first transition element preceding said nuclear trajectory region and a second transition element following said nuclear trajectory region; and using said data structure to discard a portion of said time-series data corresponding to one of said first and second transition elements.

8. A method for performing concatenative speech synthesis, comprising:

defining a statistical model for representing time-varying properties of speech;

providing a plurality of time-series data corresponding to different sound units containing the same vowel;

extracting speech signal parameters from said time-series data and using said parameters to train said statistical model;

using said trained statistical model to identify a recurring sequence in said time-series data and associating said recurring sequence with a nuclear trajectory region of said vowel;

using said recurring sequence to delimit a unit overlap region for each of said sound units;

concatenatively synthesizing a new sound unit by overlapping and merging said time-series data from two of said different sound units based on the respective unit overlap region of said sound units.

9. The method of claim 8 further comprising selectively altering the time duration of at least one of said unit overlap regions to match the time duration of another of said unit overlap regions prior to performing said merging step.

10. The method of claim 8 wherein said statistical model is a Hidden Markov Model.

11. The method of claim 8 wherein said statistical model is a recurrent neural network.

12. The method of claim 8 wherein said speech signal parameters are include speech formants.

13. The method of claim 8 wherein said statistical model has a data structure for separately modeling the nuclear trajectory region of a vowel and the transition elements surrounding said nuclear trajectory region.

14. The method of claim 8 wherein the step of training said model is performed by embedded re-estimation to generate a converged model for alignment across the entire data set represented by said time-series data.

15. The method of claim 8 wherein said statistical model has a data structure for separately modeling the nuclear trajectory region of a vowel, a first transition elements preceding said nuclear trajectory region and a second transition element following said nuclear trajectory region; and using said data structure to discard a portion of said time-series data corresponding to one of said first and second transition elements.

* * * * *